US006430981B1

(12) United States Patent
Hardtke

(10) Patent No.: US 6,430,981 B1
(45) Date of Patent: Aug. 13, 2002

(54) METHOD AND DEVICE FOR PRODUCING LEADTHROUGHS ON HOLLOW PROFILES

(75) Inventor: Uwe Hardtke, Neu Wulmstorf (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/884,449

(22) Filed: Jun. 20, 2001

(30) Foreign Application Priority Data

Jun. 20, 2000 (DE) ..... 100 29 321

(51) Int. Cl.[7] ..... B21D 28/28
(52) U.S. Cl. ..... 72/55; 72/58; 29/421.1
(58) Field of Search ..... 72/55, 57, 58, 72/61, 62; 29/421.1, 397.2

(56) References Cited

U.S. PATENT DOCUMENTS

| | | | | | |
|---|---|---|---|---|---|
| 5,666,840 | A | * | 9/1997 | Shah et al. | 72/336 |
| 5,799,524 | A | | 9/1998 | Schäfer et al. | 72/55 |
| 6,098,437 | A | * | 8/2000 | Kocer et al. | 72/55 |
| 6,158,122 | A | * | 12/2000 | Skudutis | 29/421.1 |
| 6,209,372 | B1 | * | 4/2001 | Freeman | 29/421.1 |

FOREIGN PATENT DOCUMENTS

| | | | | |
|---|---|---|---|---|
| DE | 195 30 055 A1 | | 2/1997 | |
| EP | 484789 | * | 5/1992 | 72/55 |

* cited by examiner

*Primary Examiner*—David Jones
(74) *Attorney, Agent, or Firm*—Crowell & Moring LLP

(57) ABSTRACT

A method and a device for producing leadthroughs on a hollow profile useing a high fluidic pressure in an internal high-pressure forming tool. Dome-like secondary shaped elements are formed outwards in a radial direction from this hollow profile by the fluidic pressurizing. The secondary shaped elements are then reverse drawn into the interior of the hollow profile by punches at the prevailing internal high pressure. A punched slug is cut out of the base of the reverse-drawn secondary shaped element by the punch. A bent-in margin of the secondary shaped element lying next to the cutout is then straightened by the punch in a displacing movement directed further inwards by being pressed against a hollow-profile wall. To ensure the process reliability when producing the leadthrough even in the case of a hollow-profile material having low formability and to retain the strength of the hollow profile in the transition region to the leadthrough, it is provided in each case to form a secondary shaped element out of the hollow profile at two opposite locations, to reverse draw the secondary shaped elements after the forming, in each case into the hollow-profile interior by a punch in such a way that the bases are at a distance from one another in a final state of the reverse drawing, and to sever the punched slug from the respective base by interaction between the fluidic internal high pressure and an encircling cutting edge of the punch.

30 Claims, 1 Drawing Sheet

METHOD AND DEVICE FOR PRODUCING LEADTHROUGHS ON HOLLOW PROFILES

The invention relates to a method of producing leadthroughs on hollow profiles, the hollow profile being acted upon by a high fluidic pressure in an internal high-pressure forming tool, and a dome-like secondary shaped element being formed outwards in the radial direction from this hollow profile by the fluidic pressurizing, whereupon the secondary shaped element is reverse drawn into the interior of the hollow profile by means of a punch at the prevailing internal high pressure, and whereupon a punched slug is cut out of the base of the reverse-drawn secondary shaped element by means of the punch. The invention also relates to a device for carrying out such a method.

A method or a device of the generic type has been disclosed. by DE 195 30 055 A1 (corresponding U.S. Pat. No. 5,799,524). To form bearing bosses on transverse links or double-transverse-link front axles of motor vehicles, a reverse-drawing process operated with fluidic internal high pressure is described here. In this case, dome-like necking is formed out of a hollow body under internal high pressure, this dome-like necking being reverse drawn by a punch in a central region into the interior of the hollow profile against the internal high pressure. The reverse drawing is effected until the necking wall acted upon by the punch comes to bear against the opposite wall of the hollow profile. Up to that point, the opposite wall is supported in a fixed position by a counterstay punch. Once the walls come to bear against one another, the counterstay punch is retracted. The punch which hitherto served for the reverse drawing is advanced further, in the course of which, by means of a cutting edge, it cuts off that part of the necking wall which is acted upon. The wall supported by the counterstay punch is sheared off via a sharp edge of the leadthrough in which the counterstay punch is guided. In a further forward movement, the reverse-drawing punch presses the bent-in margin of the necking cutout outwards and at the same time presses it against the opening margin of the cutout opening of the hollow-profile wall opposite the necking. This type of reverse drawing is not possible in some applications, since the hollow-profile material cannot apply the requisite. expansions during the forming on account of its material properties and/or the geometrical dimensions of the leadthrough to be produced (excessive height), as a result of which cracks or fractures may therefore occur in the process, so that the process reliability in the method of producing such leadthroughs or bearing bosses is not ensured. Furthermore, due to the generous reverse drawing, the thickness of the hollow profile material is greatly reduced in the transition region from the leadthrough to the surrounding component, as a result of which the strength of the leadthrough is adversely affected, this strength being absolutely necessary in certain structures for attaching further components—for example shock absorbers—in the leadthrough.

An object of the invention is to develop a method of the generic type and a device of the generic type to the effect that the process reliability when producing the leadthrough is ensured even in the case of a hollow-profile material having low formability and the strength of the hollow profile in the transition region to the leadthrough is retained.

According to certain preferred embodiments of the invention, the object is achieved with regard to the production method by providing a method of the type referred to above, wherein after the forming, the secondary shaped elements are each reverse drawn into the hollow-profile interior by a punch in such a way that the bases are at a distance from one another in a final state of the reverse drawing, and wherein the punched slug is severed from the respective base by interaction between the fluidic internal high pressure and an encircling cutting edge of the punch. This object is achieved with regard to the device by providing a device for producing leadthroughs on hollow profiles, comprising an internal high-pressure forming tool which has a branch branching off radially from the tool impression for forming a dome-like secondary shaped element by fluidic pressurizing, and a punch which is guided in t he b ranch of the impression and by which the secondary shaped element can be reverse drawn into the interior of the hollow profile at the prevailing internal high pressure and which has a cutting edge for cutting a punched slug out of the base of the reverse-drawn secondary shaped element, wherein two branches are formed in the forming tool and are arranged on two opposite sides of the impression, wherein in each case a punch is guided in the two branches, wherein the punches are controlled in such a way that, after an end position during the reverse-drawing operation has been reached, end faces of the punches are at a distance from one another by more than a sum of wall thicknesses of bases of the reverse-drawn secondary shaped elements, and wherein the punches are designed with an encircling cutting edge in such a way that a punched slug can be severed from the respective base in interaction with the fluidic internal high pressure.

Thanks to the invention, due to the smaller drawing length, now required, of the secondary shaped element or of the necking and smaller reverse-drawing travel, the transition region to the leadthrough is subjected to considerably less loading by a reduction in thickness of the material, so that the strength of the hollow profile there is sufficiently ensured. Furthermore, the use of materials which have only low extension properties and low elastic limits and therefore had to be ruled out in the case of the known methods is thus possible for the hollow profile. Since the risk of cracks in the hollow profile no longer occurs on account of the reduced tensile stress, the process reliability is ensured. To the same extent as the reduced reverse-drawing travel, the avoidance of additional displacing travel of the punches for cutting a punched slug out of the reverse-drawn necking or the reverse-drawn secondary shaped element contributes to the process reliability in the invention.

By the clamping of the punched slug in a receiving hollow of the punches according to certain preferred embodiments, the punched slug, in a simple manner, can be removed from the impression of the internal high-pressure forming tool. Thus, the problem occurring in other methods with the removal of the punched slug from the impression can easily be rectified and the process reliability for subsequent forming operations is ensured due to the fact that there are no overlooked punched slugs in the impression or there are no punched slugs in the impression which are jammed at locations of the impression where access is difficult. Due to the fact that the fluidic internal high pressure provides active assistance when the punched slug is being cut off, the mechanical wear on the punch is reduced, since no additional tool which comes into wearing engagement with the punch is required.

Expedient configurations of the invention may be gathered from the description and the claims.

Other objects, advantages and novel features of the present invention will become apparent from the following detailed description of the invention when considered in conjunction with the accompanying drawings.

DETAILED DESCRIPTION OF THE DRAWINGS

Figure 1:
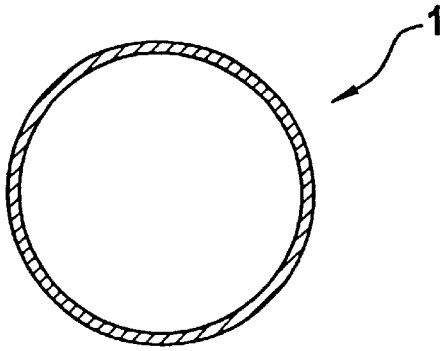
FIG. 1 shows a cross section of an unstrained hollow profile to be processed in a preferred embodiment of a method according to the invention.

A tubular hollow profile 1 having a circular-cylindrical cross section is shown in FIG. 1. The hollow profile 1 is inserted into the impression of a split internal high-pressure forming tool and squeezed into the preform of a box profile 2 by the closing of the forming tool.

In this case, beads 5 of trapezoidal cross section which are opposite one another and run axially relative to the box profile 2 are additionally embossed on the top and bottom sides 3, 4. The embossments may be effected by two inwardly projecting embossing bulges which are integrally formed on the impression and which are opposite one another with respect to the impression, or by other embossing means, such as, for example, by embossing punches guided in the tool and having a contour corresponding to the negative shape of the beads 5. The design of the beads 5 results in exceptional reinforcement of the transition region between the leadthrough 13 and the adjoining hollow profile 1, so that the high bearing forces to be expected can be absorbed without any problems. The box profile 2 and the beads 5 can also be produced outside the internal high-pressure forming tool. It is likewise conceivable to form the embossment during the admission of the internal high pressure to the hollow profile, as a result of which the beads 5 are formed exactly.

Figure 2:
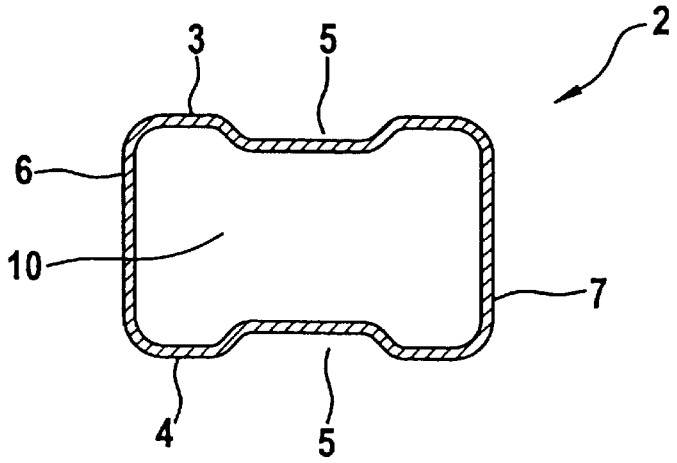
FIG. 2 shows a cross section of the hollow profile from FIG. 1 after forming it into a box profile while embossing beads on it.

At the same time, in a manner which is economical in terms of the method, the squeezed box profile 2, which therefore still does not correspond to the desired final shape, is opened out and then exactly assumes the final shape (FIG. 2). It is not absolutely necessary to form a box profile 2 though. However, before the secondary shaped elements 9 are formed, the beads 5 running axially relative to the hollow profile 1 are to be embossed on the circumference of the hollow profile 1 so as to be offset by 90° from the secondaryshaped elements 9. On the sides 6 and 7 of the box profile 2 thus produced, two dome-like secondary shaped elements 9 are formed radially outwards so as to be in alignment opposite one another on account of the admission of fluid high pressure. To form the said secondary shaped elements 9, the internal high-pressure forming tool there in each case has a branch branching off radially from the tool impression.

Figure 3:
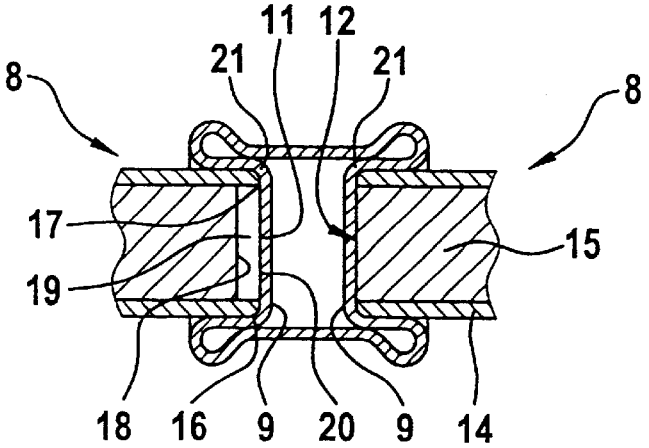
FIG. 3 shows a cross section of the hollow profile from FIG. 2 with the secondary shaped elements being reverse drawn in the internal high-pressure forming tool by punches, on one side during the cutting operation.

Guided in the respective branch of the impression is a punch 8, by which the blown-out secondary shaped element 9 is reverse drawn into the interior 10 of the box profile 2 at the prevailing internal high pressure (FIG. 3). On account of the prior forming of the secondary shaped elements 9, additional hollow-profile material is provided for the reverse drawing, a factor which increases the reverse-drawing depth in a reliable manner in terms of the process. The punches 8 are designed to be controlled in such a way that the bases 11 of the secondary shaped elements 9 are at a distance from one another in the final state of the reverse drawing. In the end position of the reverse-drawing movement, the end faces 12 of the punches 8 are at a distance from one another by more than the sum of the wall thicknesses of the bases 11 of the reverse-drawn secondary shaped elements 9. The subsequent straightening of the bent-in margin 21 produced after the cutting-out operation is thus made possible without hindrance. A robust annular collar 23 is formed on the ends of the leadthrough 13 by the reverse drawing.

In order to open the leadthrough 13 to be produced, a punched slug has to be cut out of the base 11 of the reverse-drawn secondary shaped element 9. To this end, the punch 8 is used, which includes a sleeve 14 and a plunger 15 guided with slight clearance in the sleeve 14, in which case, at the end face of the punch 8, the outer edge 16 of the sleeve 14 is rounded off and the inner edge 17 forming the cutting edge is sharp. The rounding-off of the outer edge 16 helps to ensure that notching, which can put the process reliability at risk, does not occur during the reverse-drawing operation. To sever the punched slug, the plunger 15, which can be controlled relative to the movement of the sleeve 14 and whose end face 18 terminates flush with the inner edge 17 of the sleeve 14 during the reverse-drawing operation, is withdrawn with high acceleration while the sleeve 14 remains in the end position of the reverse-drawing operation. The internal high pressure, which has an expansive effect, at the same time presses the base 11 against the encircling cutting edge, released by the withdrawal of the plunger 15, and severs a wall piece, as punched slug, from the base 11, this wall piece corresponding to the end face 18 of the plunger 15. The punched slug is then pressed into a receiving hollow 19 of the punch 8 by the internal high pressure, this receiving hollow 19 being formed by the cavity produced during the withdrawal between the end face 18 of the plunger 15 and the opening 20 of the sleeve 14.

Figure 4:
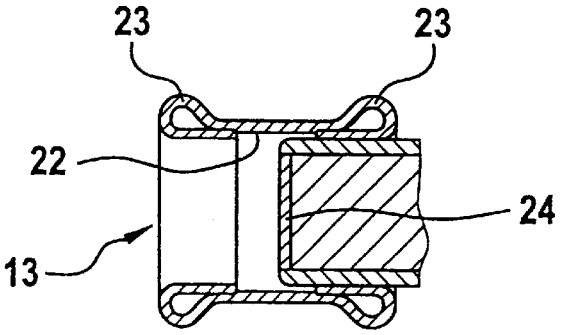
FIG. 4 shows a cross section of the hollow profile from FIG. 3, on the right-hand side before removal of the punched slugs, produced during the cutting operation, by the pressing-back action on the bent-in margin by an inwards movement of the punch, and on the left-hand side after removal of the punched slug.

The bent-in margin 21, lying next to the cutout, of the secondary shaped element 9 is then pressed back by the punch 8 in a displacing movement directed further inwards while the margin is straightened in accordance with the outer contour of the punch 8. A smooth-walled, obstacle-free leadthrough 13 is thus achieved (FIG. 4). It may sometimes be advantageous if the dimensions of the outer contour of the punch 8 relative to the bead position are such that, when the punch 8 travels inwards in order to press back the bent-in margin 21, the latter is pressed against the underside 22 of the bead 5. This leads to doubling of the sheet, at least at certain spots, which increases the strength of the location of the leadthrough 13 on the hollow profile 1 and improves the mechanical loading capacity. However, care should be taken here to ensure that the parallelism of the position of the margin 21 relative to the advance movement of the punch 8 is maintained, since otherwise undesirable irregularities in the leadthrough wall will result there. After the finished hollow profile 1 has been removed, the plunger 15 is moved forward and the punched slug 24 clamped in the receiving hollow 19 is ejected and caught in a specific manner, for example with a basket.

Alternatively, embodiments are also contemplated where the cutting edge 17 is provided on the outer contour of the plunger 15 instead of on the sleeve 14. The punching is then effected by moving the plunger 15 out of the sleeve 14 in interaction with the internal high pressure in the hollow profile 1, 2, the plunger 15 shearing the base 11 via the cutting edge 17 and thus producing a punched slug 24. However, the punched slug 24 drops into the hollow profile 1, 2, which on account of the problem with the removal of the punched slug 24 is not especially desirable, or is not possible on account of the component geometry.

The use of the method is suitable for the production of passages or bushes and for locating bores of bearings in body bearers or chassis bodies of motor vehicles and also for the production of a pedal mounting.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed:

1. A method for producing a leadthrough on a hollow profile, the hollow profile being acted upon by a high fluid pressure in an internal high-pressure forming tool, and a secondary shaped element being formed outwards in a radial direction from the hollow profile by the fluid pressure, comprising:

reverse drawing the secondary shaped element into an interior of the hollow profile by way of a punch at the prevailing internal high pressure, cutting out a punched slug of a base of the reverse-drawn secondary shaped element by way of the punch, forming the secondary shaped element out of the hollow profile at two opposite locations, reverse drawing each of the secondary shaped elements into the hollow-profile interior by the punch in such a way that the bases are at a distance from one another in a final state of the reverse drawing, and severing the punched slug from the respective base by interaction between the internal high pressure fluid and an encircling cutting edge of the punch.

2. Method according to claim 1, wherein the punched slug, as viewed from the hollow profile, is cut out from inside to outside and pressed into a receiving hollow of the punch.

3. Method according to claim 2, wherein, before the secondary shaped elements are formed, beads running axially relative to the hollow profile are embossed on a circumference of the hollow profile so as to be offset by 90° from the secondary shaped elements.

4. Method according to claim 3, wherein the embossing is effected by the tool during closing.

5. Method according to claim 2, wherein a bent-in margin of the secondary shaped element lying next to the cutout is pressed back by the punch in a displacing movement directed further inwards while the margin is straightened in accordance with an outer contour of the punch.

6. Method according to claim 5, wherein the bent-in margin is pressed against an underside of the bead.

7. Method according to claim 1, wherein, before the secondary shaped elements are formed, beads running axially relative to the hollow profile are embossed on a circumference of the hollow profile so as to be offset by 90° from the secondary shaped elements.

8. Method according to claim 7, wherein the embossing is effected by the tool during closing.

9. Method according to claim 8, wherein a bent-in margin of the secondary shaped element lying next to the cutout is pressed back by the punch in a displacing movement directed further inwards while margin is straightened in accordance with an outer contour of the punch.

10. Method according to claim 9, wherein the bent-in margin is pressed against an underside of the bead.

11. Method according to claim 7, wherein a bent-in margin of the secondary shaped element lying next to the cutout is pressed back by the punch in a displacing movement directed further inwards while margin is straightened in accordance with an outer contour of the punch.

12. Method according to claim 11, wherein the bent-in margin is pressed against an underside of the bead.

13. A device for producing a leadthrough on a hollow profile, comprising:

an internal high-pressure forming tool which has a branch branching off radially from a tool impression for forming a secondary shaped element by fluid pressure, and a punch which is guided in the branch of the impression, wherein the secondary shaped element can be reverse drawn by the punch into an interior of the hollow profile at the prevailing internal high pressure, and said punch has a cutting edge for cutting a punched slug out of a base of the reverse-drawn secondary shaped element, wherein two of said branch are formed in the forming tool and are arranged on two opposite sides of the impression, wherein in each case one of said punch is guided in the corresponding branches, so that the punches are controlled in such a way that, after an end position during the reverse-drawing has been reached, end faces of the punches are at a distance from one another by more than a sum of wall thicknesses of the bases of the reverse-drawn secondary shaped elements, and wherein the punches are designed with the cutting edge being encircling in such a way that the punched slug can be severed from the respective base in interaction with the internal high pressure fluid.

14. Device according to claim 13, wherein the punch, has a receiving hollow at an end face into which said hollow the severed punched slug can be pressed.

15. Device according to claim 14, wherein the punch includes a sleeve and a plunger guided with slight clearance in the sleeve, so that, at the end face of the punch, an outer edge of the sleeve is rounded off and an inner edge forming the cutting edge is sharp.

16. Device according to claim 15, wherein the plunger can be controlled relative to movement of the sleeve, so that an end face of the plunger is flush with the inner edge of the sleeve during the reverse-drawing, and, in order to initiate cutting-out, the plunger can be withdrawn with high acceleration while the sleeve remains in an end position of the reverse-drawing.

17. Device according to claim 16, wherein a cavity produced during withdrawal between the end face of the plunger and an opening of the sleeve forms a receiving hollow for the cut-out punched slug.

18. Device according to claim 13, wherein the device has two embossing means which are opposite one another with respect to the impression.

19. Device according to claim 18, wherein the embossing means are inwardly projecting embossing bulges which are integrally formed on the impression and a contour of the embossing means corresponds to a negative shape of a bead.

20. Device according to claim 19, wherein the punch includes a sleeve and a plunger guided with slight clearance in the sleeve, so that, at the end face of the punch, an outer edge of the sleeve is rounded off and an inner edge forming the cutting edge is sharp.

21. Device according to claim 20, wherein the plunger can be controlled relative to movement of the sleeve, so that an end face of the plunger is flush with the inner edge of the sleeve during the reverse-drawing, and, in order to initiate cutting-out, the plunger can be withdrawn with high acceleration while the sleeve remains in an end position of the reverse-drawing.

22. Device according to claim 21, wherein a cavity produced during withdrawal between the end face of the plunger and an opening of the sleeve forms a receiving hollow for the cut-out punched slug.

23. Device according to claim 18, wherein the punch includes a sleeve and a plunger guided with slight clearance in the sleeve, so that, at the end face of the punch, an outer edge of the sleeve is rounded off and an inner edge forming the cutting edge is sharp.

24. Device according to claim 23, wherein the plunger can be controlled relative to movement of the sleeve, so that an end face of the plunger is flush with the inner edge of the sleeve during the reverse-drawing, and, in order to initiate cutting-out, the plunger can be withdrawn with high acceleration while the sleeve remains in an end position of the reverse-drawing.

25. Device according to claim 24, wherein a cavity produced during withdrawal between the end face of the plunger and an opening of the sleeve forms a receiving hollow for the cutout punched slug.

26. Device according to claim 13, wherein the punch includes a sleeve and a plunger guided with slight clearance in the sleeve, so that, at the end face of the punch, an outer edge of the sleeve is rounded off and an inner edge forming the cutting edge is sharp.

27. Device according to claim 26, wherein the plunger can be controlled relative to movement of the sleeve, so that an end face of the plunger is flush with the inner edge of the sleeve during the reverse-drawing, and, in order to initiate cutting-out, the plunger can be withdrawn with high acceleration while the sleeve remains in an end position of the reverse-drawing.

28. Device according to claim 27, wherein a cavity produced during withdrawal between the end face of the plunger and an opening of the sleeve forms a receiving hollow for the cut-out punched slug.

29. Method for producing a hollow profile with a leadthrough opening, comprising:

forming a hollow profile by high internal fluidic pressure forming to have outwardly bulging sections facing one another, reverse drawing the bulging sections with punches while maintaining a high internal pressure such that bases of said bulging sections are disposed in an interior of the profile and spaced from one another, and cutting out bases of the reverse drawn bulging sections using the punches and the internal high pressure.

30. Apparatus for producing a hollow profile with a leadthrough opening, comprising:

means for forming a hollow profile by high internal fluidic pressure forming to have outwardly bulging sections facing one another, means for reverse drawing the bulging sections with punches while maintaining a high internal pressure such that bases of said bulging sections are disposed in an interior of the profile and spaced from one another, and means for cutting out bases of the reverse drawn bulging sections using the punches and the internal high pressure.

* * * * *